United States Patent [19]

Ermanski et al.

[11] 4,315,696

[45] Feb. 16, 1982

[54] EASEL-STYLE SUSPENSION BINDER

[75] Inventors: Albert G. Ermanski, Auburn; David M. Wright, Shrewsbury, both of Mass.

[73] Assignee: Wright Line Inc., Worcester, Mass.

[21] Appl. No.: 141,273

[22] Filed: Apr. 18, 1980

[51] Int. Cl.[3] ..... B42F 13/00; B42D 3/18

[52] U.S. Cl. ..... 402/70; 281/33

[58] Field of Search ..... 281/33, 15 A, 15 B; 402/70, 3, 502; 312/183, 184, 188

[56] References Cited

U.S. PATENT DOCUMENTS

| | | | |
|---|---|---|---|
| 1,077,130 | 10/1913 | England | 281/33 |
| 1,728,430 | 9/1929 | Mevi | 281/33 |
| 1,728,431 | 9/1929 | Mevi | 281/33 |
| 1,957,039 | 5/1934 | Buenger et al. | 281/33 |
| 2,046,573 | 7/1936 | Newmeyer | 281/33 |
| 3,186,114 | 6/1965 | Carter | 402/3 |
| 3,424,167 | 1/1969 | Lennartz | 312/184 |
| 4,200,945 | 5/1980 | Ellis | 281/15 A X |

*Primary Examiner*—Paul A. Bell
*Assistant Examiner*—John S. Brown
*Attorney, Agent, or Firm*—Milton E. Gilbert; Gary E. Ross

[57] ABSTRACT

A multi-ring loose-leaf binder which incorporates hooks adopted to detachably secure the binder to a horizontal bar of a suspension filing system, recessed into the top edges of its front and back covers. The binder is further provided with a hinged jack recessed within its spine and which may be extended to prop the open binder at a convenient angle to a horizontal work surface.

11 Claims, 9 Drawing Figures

EASEL-STYLE SUSPENSION BINDER

This invention relates to loose-leaf binders, and more particularly to such binders adapted to be filed in suspension filing systems and further incorporating an easel so that, when open, the contents of the binder may be displayed at a convenient angle.

Binders designed for use in suspension filing systems are well known. A commonly encountered binder of this type is a modified post binder which incorporates in its spine a centered or eccentrically mounted hook designed to detachably engage with a horizontal bar in a so-called center hook filing system. Binders of this type have been disclosed, for instance, in U.S. Pat. Nos. 3,865,445, 3,908,360 and 4,056,296.

While post-style binders are convenient for the storage of stationery items, such as computer printouts, accounting summaries and the like, which may be added to seriatim, they are not convenient for the storage of loose-leaf documents which are subject to periodic extensive revision, in that the intercalation of pages is difficult. Additionally, while some center hook suspension filing systems provide for the convenient display of the contents of open bound documents secured to them, others do not, and in any event, the documents when removed from the suspension system typically lie flat and are not necessarily displayed at a convenient angle. A further disadvantage of this style binder is that the binder is secured to the suspension file system in a spine-up position, with at least a portion of the spine and covers obscured, and thus may require, for ready access, an alternative, and possibly less convenient, title location than is provided by the spine of a standard binder.

Loose-leaf notebooks incorporating a standard multi-ring mechanism overcome the first listed of these disadvantages, in that they easily allow the removal and insertion of any page in a loose-leaf document without the necessity of removing any other. Accordingly, it is an object of the present invention to provide a multi-ring binder adapted to be filed in a suspension filing system.

Easel-style binders, designed to display, when open, their contents at a convenient angle, offer a solution to the second listed disadvantage. However, a common design of such binders makes use of specially articulated covers which not only open outwardly, away from each other, but also in part fold down to provide a stand supporting the open binder at an angle, typically 45 to 60 degrees, to a desk top or similar surface; such a design is not conveniently adaptable to suspension filing systems in that the additional degree of freedom the doubly-articulated covers enjoy may interfere with the attachment and removal of the binder from the suspension system by, for instance, becoming entangled with adjacent binders. Accordingly, another object of the present invention is to provide an easel-type binder without multiply-articulated covers, suitable for use in a suspension filing system.

Yet a further object of the present invention is to provide a loose-leaf binder adapted for center-hook suspension filing which may be filed in such a system with its spine vertical, and thus may be viewed and accessed in much the same way as a bound volume on a library shelf.

These and other objects are met in the present invention of a multi-ring loose-leaf binder which incorporates hooks into the top, or head, edges of its covers and which includes a hinged jack, recessed within its spine, which may be extended to prop the open binder at a convenient angle to a horizontal work surface.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

For a fuller understanding of the nature and objects of the present invention, reference should be had to the following detailed description taken in connection with the accompanying drawings wherein.

Figure 2:
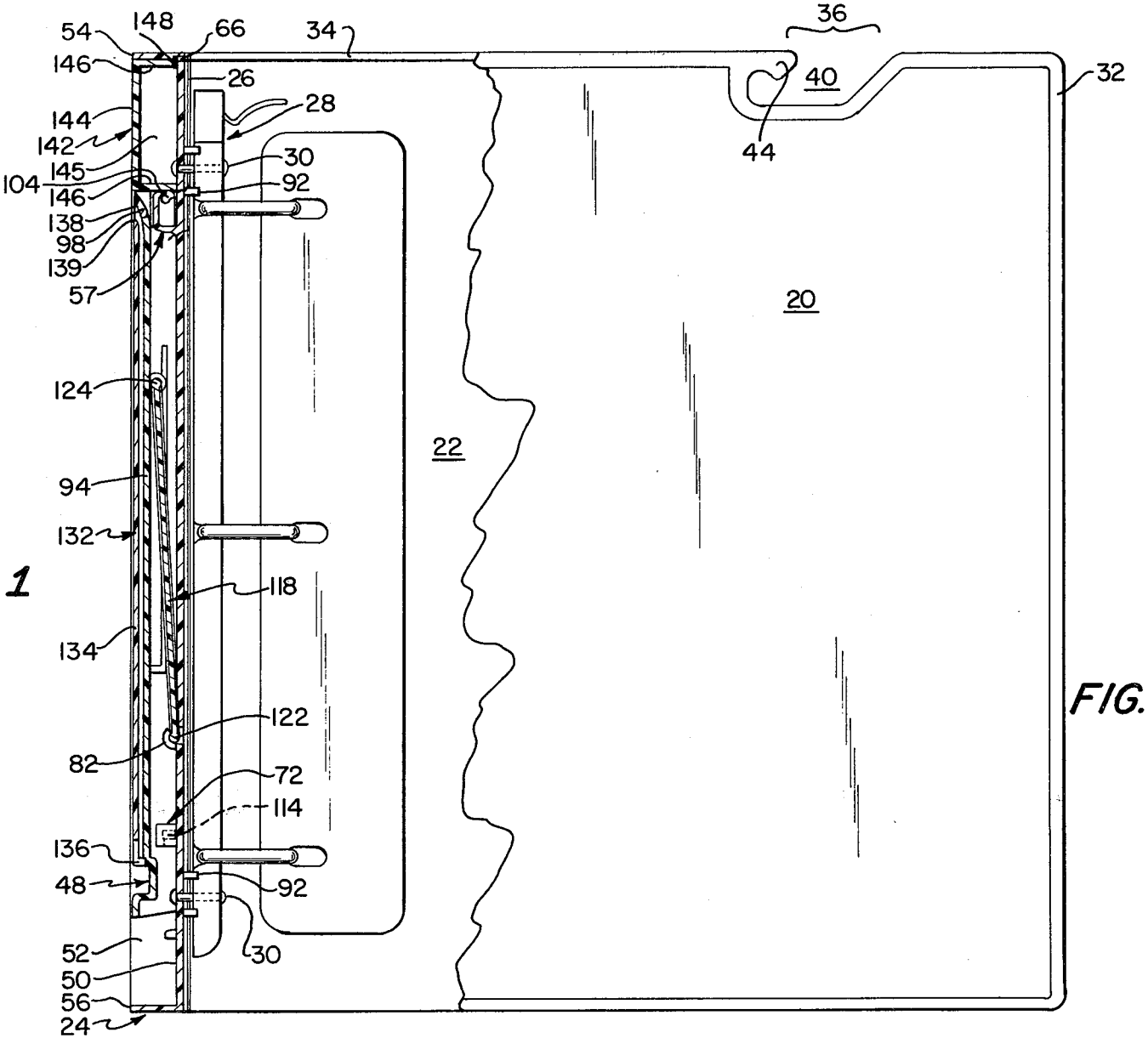
FIG. 2 is a side elevation, partially in section, of the binder of FIG. 1, the section being taken along the line 2—2 of FIG. 1 and showing the brace incorporated in the spine in its retracted position.
Figure 3:
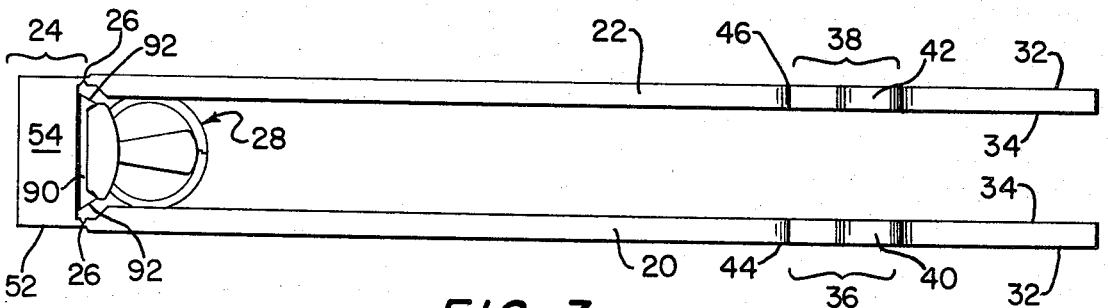
FIG. 3 is a plan view of the binder of FIG. 1.
Figure 8:
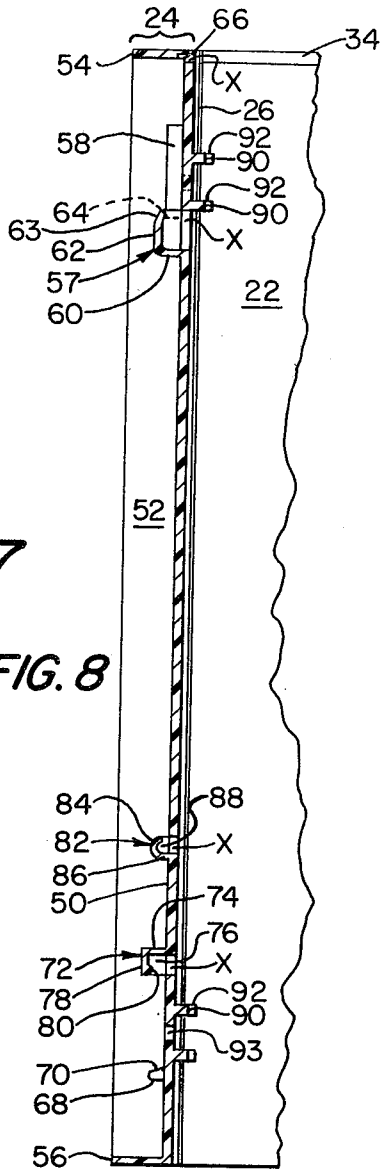
Figure 7:
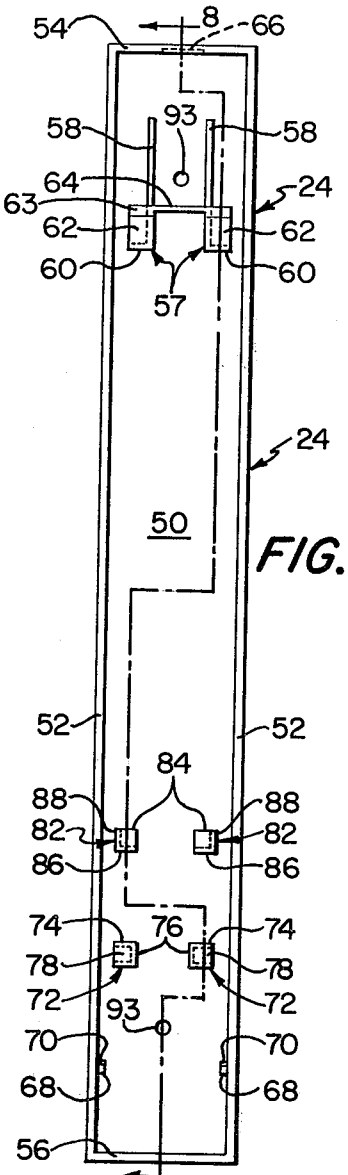
FIG. 7 is a rear elevation similar to FIG. 1 showing the spine of the binder disassembled.
Figure 9:
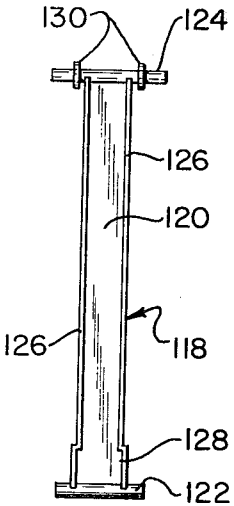

FIG. 8 is a sectional view, taken along the line 8—8, of the disassembled spine of FIG. 7; and FIG. 9 is a front elevation of the brace 118 shown assembled to the jack and the spine of the binder in FIGS. 2 and 3.

As referred to herein, the spine of the binder is considered to be to the rear, and the fore edge, to the front of the binder, and these directions should not be confused with the "front" and "rear" covers, which are the sides of the case respectively nearest the first and last pages of the document contained in the binder. Also as used herein, head and tail are respectively the directions toward the top and bottom of side-edge bound document (and also toward the top and bottom of the figures).

In all figures, like numbers refer to like parts.

DETAILED DESCRIPTION

Figure 1:
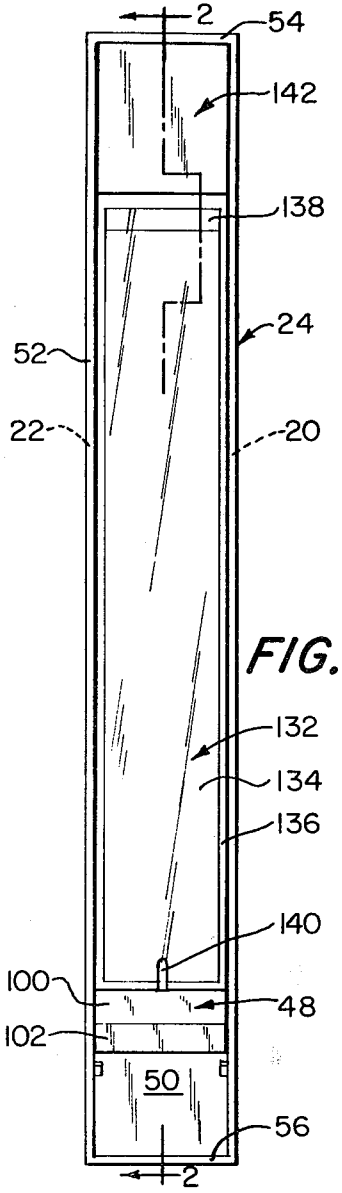
FIG. 1 is a rear elevation of the spine of a fully closed binder made in accordance with the principles of the present invention.

Referring to FIGS. 1–3, there may be seen a binder made in accordance with the principles of the present invention which in a preferred embodiment comprises a case-bound multi-ring loose-leaf binder. The case of the binder comprises front and rear covers 20 and 22 respectively, joined to opposite sides of an included spine 24 by a pair of parallel hinges 26, each conterminous with an opposite side of spine 24 and a corresponding edge of one of the covers. A conventional multi-ring mechanism 28 is affixed to the interior surface of spine 24, as by rivets 30, shown in FIG. 2, so as to support marginally punched stationery items between and in parallel arrangement with covers 20 and 22 when the latter are in the closed position illustrated in the drawings. Although not illustrated, it will be understood that covers 20 and 22 may be rotated about their respective hinges 26 so as to assume an open position, revealing the contents of the binder, wherein their respective surfaces make an obtuse angle with one another.

Preferably, covers 20 and 22, spine 24, and hinges 26 are of unitary construction, being molded in one piece from polypropylene, polyethylene, or a similar flexible polymer, the thickness of each portion being controlled so as to result in stiff covers, a rigid spine, and flexible hinges, the hinges affording the covers motion relative to the spine only about a pair of parallel axes. It will be appreciated, however, that other materials and methods of fabrication can be used for the case, provided only that the covers 20 and 22 and spine 24 are sufficiently rigid to support the weight of the binder and that the hinges 26 provide substantially only the single degree of rotational freedom just mentioned. Thus, for instance, hinges 26 can be individual double leaf hinges bonded, as by rivets, to individually formed covers 20 and 22 and spine 24. Then again, individual covers and spine may be hinged together, as in a conventional case binding, by an enclosing fabric or vinyl lining.

As may be seen by reference to FIGS. 2 and 3, front and rear covers 20 and 22 are each of similar thin, sheet-like rectangular form. The individual hinges 26 attaching front cover 20 to spine 24 are disposed parallel to and abutting corresponding rear edges of the two covers. In a preferred embodiment, covers 20 and 22 are each stiffened by an external reinforcing lip 32 and an internal reinforcing lip 34. External reinforcing lips 32 are disposed along the fore, head, and tail edges of the exterior surfaces (i.e. the surfaces of each cover which cannot come into confronting relationship with multi-ring mechanism 28) of covers 20 and 22. Internal reinforcing lips 34 are disposed about the opposite, internal, surfaces of each cover, and preferably only along the fore and head edges of each cover.

The head edges of front and rear covers 20 and 22 are respectively provided with hooks 36 and 38. Hooks 36 and 38 are congruent J-shaped incisions through covers 20 and 22, breaching the head edges of the respective covers in openings 40 and 42, and undercutting a portion of each head edge to form hooked tabs 44 and 46. Hooks 36 and 38 are disposed equidistant from the fore edges of their respective covers, so that when covers 20 and 22 are in the closed position the hooks are in confronting relationship with one another. In a preferred embodiment, the hooks are situated nearer to the fore edges of the covers than they are to the rear edges, with hooked tabs 44 and 46 nearer spine 24 than openings 40 and 42. Preferably hooks 36 and 38 are reinforced by extending external and internal reinforcing lips 32 and 34 about their peripheries.

The dimensions of front and rear covers 20 and 22 are chosen to exceed the respective dimensions of the stationery items to be secured to the binder by more than the projection of hooks 36 and 38 on the respective fore edges of covers 20 and 22 and by more than the greatest extent of multi-ring mechanism 28 away from spine 24.

Turning now to FIGS. 7 and 8, there may be seen spine 24 in rear elevation and in longitudinal section, respectively. Spine 24 is preferably of open box-like construction, in order that it may enclose the mechanism associated with jack 48, (shown assembled to spine 24 in FIGS. 1, 2 and 4), as will be described hereinafter. Spine 24 comprises five rectangular walls: back wall 50, a pair of side walls 52, and head and tail end walls 54 and 56 respectively. Back wall 50 forms the portion of spine 24 to which hinges 26 and multi-ring mechanism 28 attach, and its long and narrow dimensions correspond respectively to the height and width of the binder. Necessarily, the height depends on the height of covers 20 and 22, and the width, on the diameter of the rings of multi-ring mechanism 28 and the thicknesses of the covers. Side walls 52 abut the long edges of back wall 50, the side walls extending normally to the back wall along its entire length (i.e., along the height of the binder). Head end wall 54 extends normally to both back wall 50 and side walls 52, between the side walls and along that edge of the back wall corresponding to the head edge of covers 20 and 22; tail end wall 56 is similarly attached to the remaining edge of back wall 50. Side walls 52 and end walls 54 and 56 all extend in the same direction (to the rear), and by the same distance, from back wall 50. This distance is chosen such that the mechanism associated with jack 48, to be described, may be folded within the envelope formed by the walls. The thicknesses of all five walls are substantially equal and are chosen, based on the material of construction, to insure a rigid yet resiliently distortable spine 24.

Near head end wall 54, a pair of sockets 57 are affixed to back wall 50. Sockets 57 comprise ribs 58, segments 60, and cover plates 62. Ribs 58 are affixed to back wall 50 between and parallel to side walls 52. Ribs 58 are equally spaced from the longitudinal axis of back wall 50, and extend normal to the back wall by somewhat less than one half the distance the side and end walls do. Ribs 58 are each spaced from the side walls 52 and from head end wall 54 by a suitable distance to permit attachment of a jack 48 and an insert 142 as will be described hereinafter. The ends of ribs 58 remote from head end wall 54 terminate in short segments 60 that extend parallel to head end wall 54 and are directed from their respective ribs 58 toward the nearest side wall 52, terminating short of the wall by a distance sufficient to accommodate sides of jack 48, as hereinafter described. Each rib 58 and segment 60 is provided with a substantially rectangular cover plate 62, parallel to back wall 50, bridging between segment 60 and the associated rib 58. Cover plates 62 extend along ribs 58 a distance somewhat in excess of twice the separation between the cover plates and back wall 50. The ends of cover plates 62 nearest head end wall 54 are slightly dished toward back wall 50 by about $\frac{1}{4}$ of the distance separating the cover plates and the back wall, forming in effect a pair of reentrant lips 63 (FIG. 8).

A partition 64, parallel to head end wall 54, extends between ribs 58 in the vicinity of the end of cover plates 62 nearest the head end wall. Although not shown, the portion of partition 64 between ribs 58 and nearest back wall 50 is undercut, sufficient to accommodate a locking tab on insert 142 described hereinafter. A similar undercut, notch 66, is formed in the surface of head end wall 54 adjacent back wall 50 to accommodate a second locking tab on insert 142.

Affixed to back wall 50 and the facing surfaces of side walls 52 near tail end wall 56 are a pair of tabs 68. Each tab 68 extends normal to its respective side wall 52. Each tab 68 is provided with a slight taper (FIG. 8), the tabbecoming smaller with increasing distance from back wall 50. This taper is arranged such that tabs 68 present inclined faces 70 directed toward head end wall 54. Inclined faces 70 are spaced apart from tail end wall 56 by a suitable distance, e.g., about 2 centimeters, to allow thumb access to the tail end of jack 48 as will be described hereinafter.

A pair of catches 72 are attached to back wall 50 between tabs 68 and head end wall 54. Each catch 72 comprises an end plate 74, a side plate 76, and a top plate 78. End plates 74 are attached to back wall 50 and are disposed between side walls 52 parallel to head end wall 54 on either side of the longitudinal axis of the back wall. End plates 74 are spaced apart from their respective closest side wall 52 by about the same distance as are segments 60 of sockets 57. Each end plate 74 is sized similar to a segment 60 of sockets 57. The ends of end plates 74 nearest the longitudinal axis of back wall 50 abut side plates 76, which run parallel to side walls 52 and extend from end plates 74 toward tail end wall 56. Side plates 76 are sized similar to end plates 74. Similarly sized substantially square top plates 78, parallel to back wall 50, bridge between each end plate 74 and its attached side plate 76. Top plates 78 are affixed to their respective end and side plates by the edges of the end and side plates remote from back wall 50. The edges of top plates 78 nearest tail end wall 56 are provided with a raised lip 80, best seen in FIG. 8, directed toward back wall 50. Both catches 72 are equally spaced from segments 60 of sockets 57 by a distance depending on the dimensions of jack 48, in order to allow operation of the jack and the engagement of its lock pins 114, as hereinafter described.

Situated on back wall 50, between side walls 52 and between catches 72 and segments 60 are a pair of sockets 82. Sockets 82 are spaced equidistant on either side of the longitudinal axis of back wall 50 and are spaced apart from their respective closest side walls 52 approximately the same distance as are segments 60 of sockets 57. Sockets 82 are generally of hollow semicylindrical shape, the cylinder axis being disposed normal to side walls 52 and spaced apart from back wall 50 by a distance equal to the inside radius of the cylinder. In a preferred embodiment, the semicylindrical portion 84 of each socket 82 is attached to back wall 50 by a flat wall segment 86 normal to the back wall, tangent to the cylinder and disposed toward tail end wall 56 from the cylindrical axis. Each socket 82 is further provided with an end cap 88, parallel to side walls 52, and bridging between back wall 50, semicylindrical portion 84 and wall segment 88 at the edge of the socket nearest the closest side wall. All of the structure of socket 82 is of a thickness substantially the same as that of a wall of spine 24, and the diameter of semicylindrical portion 84 is chosen to fit a pin 122 of brace 118 as will be described. Sockets 82 are each equally spaced apart from segments 60 by a distance dependent on the dimensions of jack 48 and brace 118, to be described hereinafter, typically by a few centimeters less than are catches 72.

All of the structure of spine 24 hereinbefore described (and designated by numerals 52 through 88) are disposed on the back surface of back wall 50. Hinges 26 are disposed along the two long edges of the opposite or front surface, contiguous to the junction between back wall 50 and side walls 52. Also affixed to the front surface of back wall 50, and extending transversely across the back wall are pairs of transverse ribs 90, shown in section in FIG. 8 and in plan in FIG. 3. Transverse ribs 90 are configured and dimensioned to support multi-ring mechanism 28 in position on back wall 50 spine 24. To this end, the extremes of each transverse rib 90 are preferably provided with short locating posts 92 spaced apart by the width of multi-ring mechanism 28. The pairs of transverse ribs 90 are disposed on back wall 50 so as to bracket each of the attachment rivets 30 used to affix multi-ring mechanism 28 to spine 24. Apertures 93, sized and spaced apart to accommodate rivets 30, penetrate through back wall 50 along the back wall's longitudinal axis between each pair of ribs 90.

Back wall 50 may be additionally breached adjacent to the spaced apart parallel structure mounted thereon, in order to permit spine 24 to be molded in its entirety by a simple two-piece mold. Such pattern holes are provided in the back wall 50 illustrated at the locations marked "x" in FIG. 8, underlying notch 66, partition 64, cover plates 62, sockets 82 and catches 72.

Figure 6:
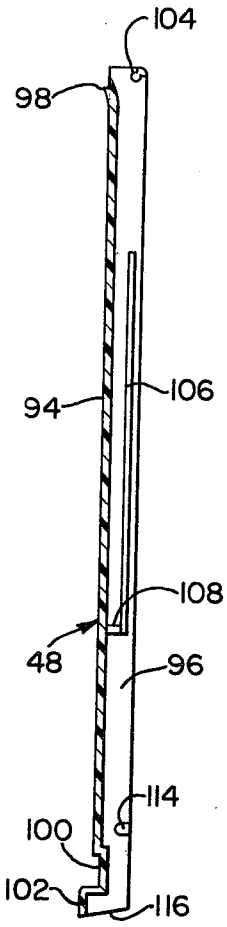
FIG. 6 is a cross-sectional view taken along the line 6—6 of the jack of FIG. 5.
Figure 5:
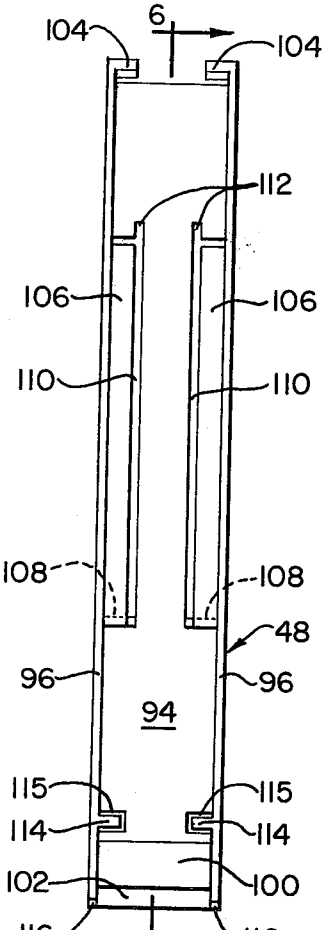
FIG. 5 is a side elevation, showing the interior surface of the jack incorporated in the spine of the binder of FIG. 1.

Turning now to FIGS. 5 and 6, there may be seen jack 48. Jack 48 is of shallow channel form, having a substantially rectangular plate 94 included between and normal to a pair of substantially rectangular sides 96. Plate 94 and sides 96 are thin-walled substantially planar sheets having thicknesses on the order of those of walls 50, 52, 55 and 56 of spine 24. The length of plate 94 is somewhat less than the overall length of jack 48, sides 96, which abut the long edges of the face extending slightly beyond the face at the head end (the top of the jack as shown). The overall length of jack 24 is chosen to be less than the separation between partition 64 and tail end wall 56 of spine 24 by a suitable amount, e.g., about 2 centimeters, to allow a user to obtain a finger purchase on the jack, as will be described hereinafter. The overall width of jack 48, as established by the width of plate 94 and the thicknesses of sides 96, is chosen to be slightly less than the separation between side walls 52 of spine 24. Sides 96 extend normal to plate 94 by a distance somewhat greater than the extent by which cover plates 62 of jack attachment sockets 57 extend above back wall 50 in spine 24.

In a preferred embodiment, the head end of plate 94 is smoothly faired into a tangent arcuate lip 98. Lip 98 is in the form of an angularly small right circular cylindrical segment, the axis of which is parallel to the head end edge of plate 94 and which is disposed away from the head end edge in the direction toward the tail end of the face and normal to the face in the direction opposite that taken by sides 96. Lip 98 extends out of the plane of plate 94 by a distance on the order of the thickness of the plate.

Preferably, the tail end of plate 94 is terminated by a two level finger hold comprised of a recessed step 100 and a raised step 102. Steps 100 and 102 are of rectangular shape, having long edges disposed transversely across jack 48, and having substantially planar surfaces parallel to the plane of plate 94. The narrow dimension (the vertical dimension in FIGS. 5 and 6) of the exposed surfaces (i.e., the surfaces directed away from sides 96) of each step 100 and 102 is chosen to accommodate a finger. Recessed step 100, is displaced normal to plate 94 toward the spine by a short distance, typically on the order of the thickness of face 94. Raised step 102, is displaced normal to plate 94 away from the spine by a somewhat larger distance, typically about twice the thickness of plate 94. The edges of sides 96 abutting steps 100 and 102 are contoured to follow the changes of level introduced by the steps. The overall extent of jack 48 normal to plate 94 at the location of raised step 102 determines the extent normal to back wall 50 of walls 52, 54, and 56 of spine 24, which are chosen to equal or slightly exceed it.

The head end corners of sides 96 furthest from plate 94 are quarter-rounded, the radius of curvature being on the order of one-half the separation between back wall 50 and cover plates 62 of spine 24. Disposed on the facing surfaces of sides 96 and nearly concentric with these rounded corners are pintles 104. Each pintle 104 extends normally from its respective side 96 by a distance slightly less than the difference between the thickness of a side 96 and the separation between a side wall 52 and the nearest rib 58. Preferably, pintles 104 are of key-hole shaped section, and comprise a slightly less than quarter round right circular cylindrical segment concentric with, of equal radius to, and contiguous with the quarter round corners, and an eccentrically situated three quarter round right circular cylindrical segment of smaller diameter. This latter cylindrical segment is centered at the same distance from the plane of plate 94 as is the former, but is displaced slightly toward the tail end of jack 48. The diameters of the segments making up pintles 104 are chosen on the basis of the strength of materials, and determine the separation chosen between back wall 50 and cover plates 62 of spine 24, this dimension being selected to be equal to the maximum thickness of a pintle.

Disposed normal to the facing surfaces of sides 96 are a pair of thin rectangular shelves 106, arranged with their long dimensions parallel to the long dimension of jack 48. Preferably shelves 106 are each about one half the length of jack 48, and each shelf extends inward from its respective side 96 about the same amount as do individual pintles 104. The thickness of each shelf is substantially that of plate 94. Shelves 106 are parallel to plate 94 and spaced apart from it a distance on the order of twice the thickness of the plate. Both shelves 106 are spaced apart from the tail end edge of their respective sides 96 by a distance of about one third the length of jack 48, the exact positioning being chosen so that the shelves extend tailward of the center of the jack yet are clear of depressed step 100 by several centimeters. The end of each shelf 106 nearest the tail end of jack 48 is connected to plate 94 by a short rectangular stop 108, normal to both shelf and plate and extending normally from the side 96 abutting the shelf to a position beyond the shelf by a distance on the order of the thickness of the shelf. Each stop 108 is of similar thickness as a shelf 106.

An aperture 110 is provided through plate 94 opposite each shelf 106. Each aperture 110 is of rectangular form, and of equal length as shelf 106, the aperture extending from stop 108 to the thickness of the stop beyond the edge of the shelf distal from the stop. The width of each aperture 110 is greater than the width of a shelf 106 by slightly more than the thickness of plate 94, the apertures extending across plate 94 from sides 96. A linear notch 112 penetrates plate 94 at the corner of each aperture 110 nearest both the longitudinal axis and the head end of jack 48. Each notch 112 is slightly greater than the thickness of face 94 in width, and extends beyond the respective aperture 110 by about twice this amount. Notches 112 are aligned parallel to and conterminous with the respective long edges of apertures 110.

Lock pins 114 are attached to the facing surfaces of sides 96 in the vicinity of depressed step 100. Each of the two lock pins extends normal the respective side 96 the same order of distance as the maximum thickness of a pintle 104. In form, each lock pin 114 has an arch-shaped cross section, the base of the arch being contiguous with the edge of the respective side 96 distal from plate 94. Each pin 114 extends lengthwise along its respective side 96 a distance on the order of the thickness of a side and extends from the edge of the side toward plate 94 about twice this distance. Each lock pin 114 is disposed on jack 48 such that the center-to-center distance between a lock pin and the corresponding pintle 104 is equal to the distance between the planes of partition 64 and end plates 74 in spine 24, this latter distance preferably having been established to place lock pin 114 slightly nearer to the pintles than is depressed step 100. As an aid in manufacturing, plate 94 is provided with a pair of pattern holes 115 opposite each lock pin 114.

The tail end edges of each side 96 are preferably provided with a slightly out of square profile, forming beveled edges 116. Bevelled edges 116 approach the head end of jack 48 the further the edges become from plate 94. The angle bevelled edges 116 make with respect to the plane of plate 94 is selected to be substantially the same as the angle a line connecting the tail end of jack 48 with the tail end of spine 24 makes with the plane of plate 94 when the binder is fully assembled and the jack is in its extended position to be described hereinafter. Typically, this angle is some 10 to 20 degrees less than a right angle.

Considering now FIG. 9, there may be seen a molded brace 118. Brace 118 is one piece and comprises strut 120 and pins 122 and 124. Strut 120 is a thin-walled substantially rectangular body. The length of strut 120 is preferably on the order of one half the length of jack 48, and its width is chosen to be less than the separation between stops 108 of the jack. The thickness of strut 120 is selected on the basis of the strength of materials, in order to provide a reasonably stiff strut, and is preferably on the order of the thicknesses of walls 50, 52, 54 and 56 of spine 24. To improve the stiffness of strut 120, it may be formed with peripheral stiffening ribs 126, provided the overall thickness of the strut is not made excessive.

Pin 122 is attached to one end of strut 120 so as to extend in line with the end beyond the sides of the strut. Pin 122 is disposed so as to extend equally on either side of the longitudinal axis of strut 120. Pin 122 is of right circular cylindrical section and has a diameter sufficient to provide strength. The length of pin 122 is chosen to be slightly less than the separation between end caps 88 of sockets 82 in spine 24. In a preferred embodiment, the attachment of pin 122 to strut 120 is buttressed by a somewhat wider section 128 of strut. Section 128 is of rectangular form and is centered on and extends along pin 122 a distance somewhat less than the separation between sockets 82 in spine 24.

Pin 124 is attached to the end of strut 120 remote from pin 122 so as to extend in line with the end. Pin 124 is so disposed as to extend beyond the sides of strut 120 by equal distances on either side. Pin 124 is of right circular cylindrical section and has a diameter substantially equal to the separation between face 94 and shelves 106 of jack 48. The length of pin 124 is chosen to be slightly less than the separation between sides 96 of jack 48. Pin 124 is provided with a pair of flanges 130 each of which radially extends beyond the pin by an amount not in excess of the thickness of plate 94 of jack 48. Flanges 130 are equally spaced from the longitudinal axis of strut 120 and are spaced apart a distance equal to the separation between apertures 110 in plate 94 of jack 48. The thickness (i.e., the axial extent) of each flange 130 is chosen to be slightly less than the difference between the widths of an aperture 110 and the shelf 106 with which the aperture is aligned.

Figure 4:
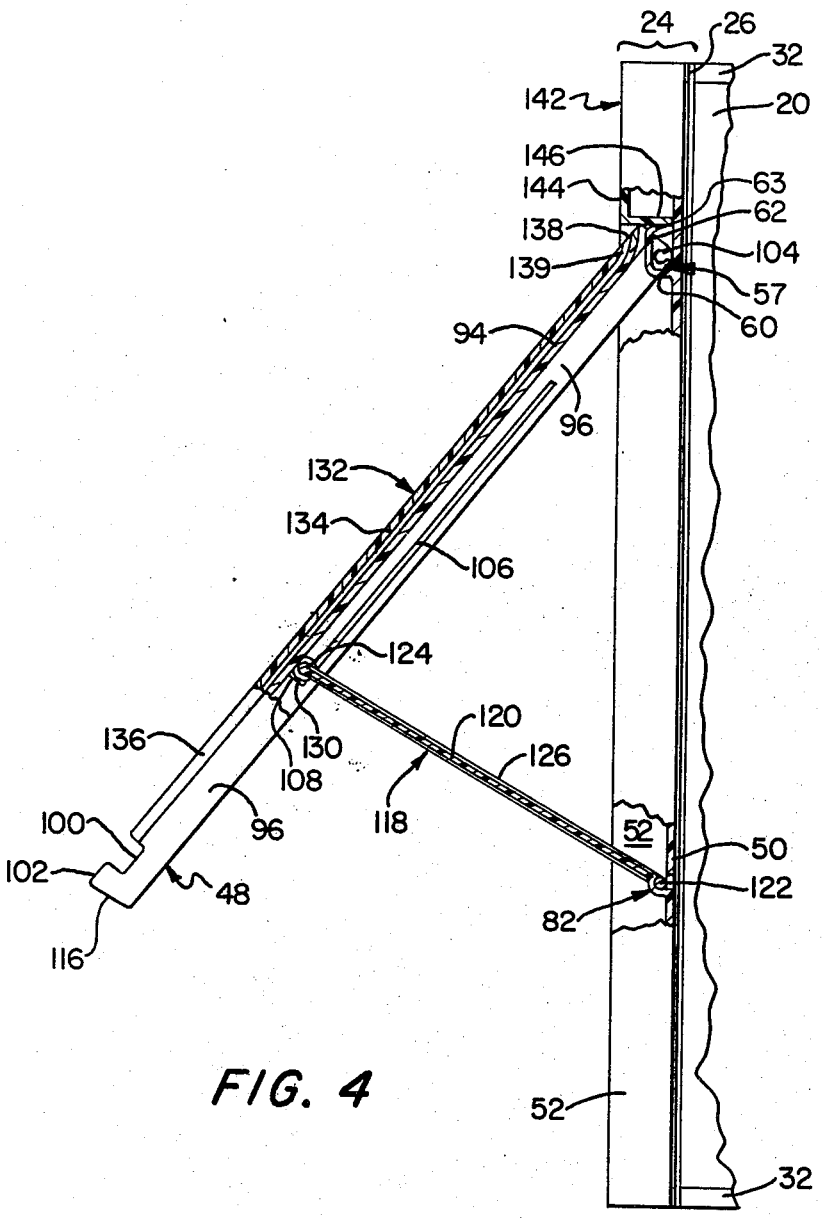
FIG. 4 is a fragmentary side elevation, partially in section, of the binder in FIG. 1, showing the jack incorporated in the spine of the binder in its extended position.

In a preferred embodiment, the binder is provided with a label holder 132, best seen in FIGS. 1, 2 and 4. Label holder 132 is of transparent material, such as polycarbonate, polystyrene, acrylic, or other similar polymer, and is shaped and dimensioned to just cover plate 94 of jack 48 between the head end of the jack and depressed step 100. Label holder 132 comprises a cover section 134 and a spacer rib 136. Cover section 134 is a thin planar plate with a substantially rectangular form having the same dimensions as that of plate 94 of jack 48. Spacer 136 is a rib formed along the sides and tail end of cover section 134. Rib 136 fits in a shallow depression formed along the sides and tail end of plate 94. Spacer rib 136 extends beyond the head end of cover 134 in the same manner that sides 96 extend beyond the head end of plate 94 in jack 48. The head end of label holder 132 is provided with a rigid guide section 138 located beyond the head end of cover section 136. Guide section 138 extends transversely of cover section 134, being connected at its ends the side portions of spacer 136. Guide 138 is a thin-walled generally cylindrical segment matching the curvature of lip 98 of face 94 of jack 48. Guide 138 is so disposed as to abut lip 98 as shown in FIG. 2 when label holder 132 is placed so that its spacer rib is engaged with plate 94 of jack 48 with the open end of spacer 136 conterminous with the head ends of sides 96 of the jack. The head end edge of cover 134 opposite guide section 138 is provided with a bevel 139 (FIG. 2) concentric with the guide section. The gap between bevel 139 and guide section 138 forms an opening for inserting a label to the space between cover 134 and plate 94 of jack 48. The tail end of cover 134 and spacer rib 136 are cut through by a narrow slot 140 which substantially extends along the longitudinal axis of label holder 132. Preferably slot 140 has a length slightly in excess of the distance separating the head end of plate 94 of jack 48 from the head end of sides 96.

The head end of spine 24 is further provided with an insert 142. Insert 142 is preferably formed from acrylonitrile-butadiene-styrene or similar material having the requisite springiness for snap-fit assembly. In form, insert 142 is of hollow open boxlike construction, having a rectangular face 144 included between a pair of opposite sides 145 and a pair of opposite ends 146. Insert 142 is sized to closely fit within the head end of spine 24 with sides 145 in close confronting relationship with the facing surfaces of side walls 52 and ends 146 between and in close confronting relationship with head end wall 54 and partition 64. The center sections of ends 146 distal from face 144 are provided with notched spring tabs 148 (only the one for the end facing head is shown in FIG. 2) dimensioned to engage with notch 66 in the head end wall and with the undercut (not shown) of partition 64.

The assembly of the jack 48 to the binder will now be described. Label holder 132 is positioned on jack 48 with spacer 136 in contact with plate 94, with the long sides of the spacer being parallel to and conterminous with sides 96 and guide 138 abutting lip 98. In this position, label holder 132 is then attached to jack 48, as by ultrasonic welding or other means.

Sockets 82 are spread open to accommodate pin 122 of brace 118, so that the pin is snapped in place, and pin 124 of brace 118 is inserted into the track in jack 48 formed between shelves 106 and plate 94. The latter operation is accomplished by bringing the ends of shelves 106 nearest the head end of jack 48 opposite and parallel to pin 124 with the pin extending between sides 96 of the jack. Flanges 130 on pin 124 are inserted into notches 112 in plate 94 of the jack, and the jack is moved relative to brace 118 so as to bring pin 124 toward stop 108, thereby movably captivating jack 48 to brace 118.

The head end of jack 48 is attached to spine 24 by inserting the head ends of sides 96 of the jack between side walls 52 of the spine so as to bring the quarter-rounded portion of pintles 104 into contact with back wall 50 between head end wall 54 and partition 64. Keeping pintles 104 in contact with back wall 50, the head end of jack 48 is brought toward the tail end wall 56 of spine 24 so as to bring the pintles into sockets 57. It will be appreciated that, as the thicknesses of the walls and structure of spine 24 are so chosen as to be rigid yet resiliently distortable, reentrant lips 63 of top plates 62 of the sockets may be sprung away from back wall 50 during the insertion of pintles 104 into sockets 57. After jack 48 has been connected to sockets 57, pintles 104 are moved into contact with segments 60 of the sockets, and insert 142 is attached. Insert 142 is aligned with the head end of spine 24 with sides 145 of the insert between side walls 52 of the spine with ends 146 between head end wall 54 and partition 64, and with the sides and ends of the insert nearer back wall 50 than is face 144. Spring tabs 148 of inset 142 are deflected inward, toward one another, and the insert is brought into contact with back wall 50, at which point the spring tabs come opposite notch 66 in head end wall 54 and the undercut in partition 64. At this point, spring tabs 148 snap into place in notch 66 and the undercut in partition 64 locking insert 142 in place. With insert 142 in place, the open ends of sockets 57 are closed by the insert captivating pintles 104 while allowing them to both rotate and translate relative to sockets 57.

When brace 118 is interconnected with jack 48 and spine 24 as described hereinbefore, brace 118 may be simultaneously translated and rotated relative to the jack, permitting the aforementioned rotation and translation of the jack about pintles 104. Motion of the tail end of jack 48 toward spine 24 bring bevelled edges 116 of the jack into contact with inclined faces 70 of tabs 68 of the spine, with the result that lock pins 114 are urged toward catches 72. This translational motion of jack 48 toward the head end of spine 24 is made possible by the longitudinal extent of sockets 57 in which pintles 104 are captivated. As lock pins 114 enter catches 72, the half-rounded faces of the lock pins encounter raised lips 80 of top plates 78 of the catches. Further motion of lock pins 114 resiliently distorts top plates 78 of the catches away from back wall 50 until the apexes of the lock pins pass beyond raised lips 80, after which the elastic restoring forces in the top plates relax, forcing the top plates toward back wall 50, the raised lips thereby captivating the lock pins. At the same time, pintles 104 come in contact with reentrant lips 63, firmly seating the head end of jack 48 against back wall 50 while catches 72 and lock pins 114 similarly seat the tail end of the jack. In this retracted position, jack 48 is nested into the recess in spine 24 formed by side and end walls 52, 54, and 56, with cover 134 of label holder 132 and raised step 102 of the jack level with the edges of the walls distal from back wall 50.

Jack 48 may be opened by grasping recessed step 100 and raised step 102 and sliding the jack toward tail end wall 56. By this action, lock pins 114 are snapped out of catches 72. Continued tailward motion of jack 48 brings bevelled edges 116 of the jack into contact with inclined faces 70 of tabs 68 just prior to contact between pintles 104 of the jack and segments 60 of sockets 57. Jack 48 may now be rotated about pintles 104, extending the tail end of the jack away from the tail end of spine 24. Simultaneously, brace 118 pivots about sockets 82, pin 124 sliding along shelves 106 of the jack. Preferably sockets 82 are so located and shelves 106 are so situated that pin 124 may slide along shelves 106 through the point where brace 118 is normal to the shelves, so that when the brace is manually moved to the full extent of its travel, coming against stops 108, the brace is in an over-centered, locked position (i.e., the included angle between the brace and jack 48 is less than 90 degrees). In this extended position of jack 48, the binder may be rested, at an angle suitable for reading, on bevelled edges 116 of the jack, tail end wall 56 of spine 24, and either or both tail end edges of open front and rear covers 20 and 22.

The binder, when closed may be easily secured to a filing system having a horizontal bar (not shown) by hooks 38 and 36, the bar entering the hooks through openings 40 and 42 and coming to rest, supporting the binder under hooked tabs 44 and 46. The disposition of hooks 38 and 36 with openings 40 and 42 being more remote from spine 24 than are hooked tabs 44 and 46 allows the binder to be engaged to such a horizontal bar in much the same way as the binder would be shelved on an ordinary shelf, the binder being addressed to the bar fore-edge first. The eccentric mounting of hooks 38 and 36 produces a deliberate imbalance of the binder, with the fore-edge of the binder tending to rise above spine 24. This deliberate imbalance particularly suits the binder of the present invention for use with filing systems of the type described in U.S. Patent 3,980,360, wherein a flange, not shown, by contact on the fore-edge portion of the head edge of covers 20 and 22, both maintains spine 24 vertical in the stored position, and provides, with the center of gravity of the binder, a couple which tends to better secure hook 32 on the supporting bar of the filing system.

Label cards (not illustrated) may be inserted into label holder 132 through the aperture between guide 138 and bevel 139, the label when fully inserted being positioned between plate 94 of jack 48 and cover 134 of the label holder. A sharp instrument, such as a pencil tip, may gain purchase on the tail end of a label through slot 140 as an aid in removing a label.

It will be apparent that the invention is susceptible of being practice otherwise than as herein illustrated. For example, hooks 36 and 38 need not be eccentrically mounted, nor the head end edge of covers 20 and 22 be provided with single hooks. Further, the case comprising covers 20 and 22 and spine 24 may be assembled from separate parts rather than being of unitary construction. Since these and other changes may be made in the above described apparatus without departing from the scope of the invention herein involved, it is intended that all matter contained in the above description or shown in the accompanying drawings shall be interpreted in an illustrative and not in a limiting sense.

What is claimed is:

1. In a loose-leaf binder of the type having a rigid spine provided with a multiple ring device for releasably securing thereto appropriately punched stationery items and further having a pair of stiff covers of rectangular form hinged to said spine so as to be rotatable about a pair of parallel axes between a first closed position wherein said covers are in opposing and confronting relationship with one another and a second open position wherein said covers form an obtuse angle with one another, the improvement comprising:

a pair of congruent hook-shaped indentations in corresponding single edges of said covers, said single edges being normal to said axes and said identations being so disposed along said single edges as to fall opposite one another when said stiff covers are in said first closed position, said indentations further defining a hook portion and an opening, with said hook portions being between said openings and said spine, said indentations being situated eccentrically along said single edges so as to be remote from said spine;

a retractable jack hinged to said spine about an axis normal to said parallel axes so as to be movable between a retracted position parallel to said parallel axes and an extended position making an angle with a plane parallel to said parallel axes, said jack being of substantially rectangular form and being provided with a transparent label-holding cover, and said spine being of substantially rectangular open box-like construction dimensioned to accept said jack when said jack is in said retracted position so as to expose a view substantially only said transparent label holding cover of said jack;

a lock, comprised of a lock means on said spine and a lock pin on said jack which may be engaged with one another to secure said jack in said retracted position; and a locking brace movably secured to said jack and said spine to secure said jack in said extended position;

whereby when said jack is in said extended position and said binders are in said second open position, said binder may be supported on a surface by said jack, one end of said spine, and at least one of said covers with said spine inclined to said surface and said hooks remote therefrom.

2. In a loose-leaf binder of the type having a rigid spine provided with a multiple ring device for releasably securing thereto appropriately punched stationery items, and further having a pair of covers hinged to said spine so as to be rotatable about a pair of parallel axes between a first closed position wherein said covers are in opposing and confronting relationship with one another, and a second open position wherein said covers are at an obtuse angle to one another, said binder further being provided with a retractable jack hinged to said spine about an axis normal to said parallel axes so as to be movable between a retracted position parallel to said parallel axes and an extended position making an angle with a plane parallel to said parallel axes, whereby when said jack is in said extended position and said binder covers are in said second open position, said binder may be supported on a surface by said jack, one end of said spine, and at least one of said covers with said spine inclined to said surface, said jack being provided with a lock to secure said jack in said retracted position, the improvement wherein further said lock comprises a lock means on said spine and a lock pin on said jack and said jack is hinged to said spine by a pintle engaged in elongated sockets so as to be additionally movable along said spine whereby said lock means and said lock pin may be engaged.

3. A loose-leaf binder according to claim 2 wherein said elongated sockets are integral with said spine and remote from said one end thereof and said pintle is in the form of a pair of posts integral with said jack.

4. A loose-leaf binder according to claim 3 wherein further said elongated sockets are each provided with an open end facing away from said one end of said spine and so dimensioned as to allow the posts of said pintle to pass therethrough and said spine is further provided with a means to close off said open ends thereby captivating said pintle.

5. A loose-leaf binder according to claim 4 wherein further said spine is of open box-like form, said elongated sockets are disposed within said spine, and said means to close off said open ends is an insert which may be positioned inside said spine.

6. A loose-leaf binder according to claim 3 or 4 wherein said lock means comprises at least one open-ended catch facing away from said elongated sockets and situated remote therefrom and said lock pin comprises a like number of posts dimensioned to fit said sockets.

7. A loose-leaf binder according to claim 3 or 4 wherein further said jack is provided with a step-like structure remote from said pintles dimensioned and disposed to form a finger grip.

8. A loose-leaf binder according to claim 2 wherein further said jack is of substantially rectangular form and includes integral therewith a transparent label-holding cover.

9. A loose-leaf binder according to claim 8 wherein further said spine is of substantially rectangular open box like construction dimensioned to accept said jack when said jack is in said retracted position so as to expose to view substantially only said transparent label holding cover of said jack.

10. In a loose-leaf binder of the type having a rigid spine provided with a multiple ring device for releasably securing thereto appropriately punched stationery items and further having a pair of covers hinged to said spine so as to be rotatable about a pair of parallel axes between a first closed position wherein said covers are in opposing and confronting relationship with one another, and a second open position wherein said covers are at an obtuse angle to one another, said binder being further provided with a retractable jack hinged to said spine about an axis normal to said parallel axes so as to be movable between a retracted position parallel to said parallel axes and an extended position making an angle with a plane parallel to said parallel axes, whereby when said jack is in said extended position and said binder covers are in said second open position, said binder may be supported on a surface by said jack, one end of said spine, and at least one of said covers with said spine inclined to said surface, the improvement comprising a locking brace in the form of an elongate member having first and second ends, said first end being hinged to said spine about an axis parallel to the axis about which said jack is hinged to said spine and said second end being slidably affixed to said jack so that when said jack is moved to said extended position, said brace passes through an over-center condition thereby becoming locked; and wherein further said brace is provided with a plurality of pins disposed normal to its length at said first and second ends, said pins at said first end being substantially coaxial and being dimensioned and disposed to pivotally fit into sockets on said spine, thereby forming a hinge, and said pins at said second end being substantially coaxial to one another and parallel to said pins at said first end and further being dimensioned and disposed to pivotally and slidably engage a pair of shelf-like structures on said jack.

11. In a loose-leaf binder of the type having a rigid spine provided with a multiple ring device for releasably securing thereto appropriately punched stationery items and further having a pair of covers hinged to said spine so as to be rotatable about a pair of parallel axes between a first closed position wherein said covers are in opposing and confronting relationship with one another, and a second open position wherein said covers are at an obtuse angle to one another, said binder further including a retractable jack hinged to said spine about an axis normal to said parallel axes so as to be movable between a retracted position parallel to said parallel axes and an extended position making an angle which a plane parallel to said parallel axes whereby when said jack is in said extended position and said binder covers are in said second open position, said binder may be supported by surface by said jack, one end of said spine, and at least one of said covers with said spine inclined to said surface, the improvement wherein further said jack is of substantially rectangular form and includes integral therewith a substantially rigid transparent label holding cover also of rectangular form having a guide ramp and a through slot which serves as an aid in insertion and removal of a label, respectively.

* * * * *